US007692602B2

(12) United States Patent
Wu et al.

(10) Patent No.: US 7,692,602 B2
(45) Date of Patent: Apr. 6, 2010

(54) CONTROL SYSTEM OF ANTENNA ARRAY OF RFID READER APPLICATIONS

(75) Inventors: Che-Ming Wu, Hsinchu (TW); Tien-Fa Hou, Hsinchu (TW)

(73) Assignee: G-Time Electronic Co., Ltd., Hsinchu (TW)

( * ) Notice: Subject to any disclaimer, the term of this patent is extended or adjusted under 35 U.S.C. 154(b) by 1083 days.

(21) Appl. No.: 11/347,846

(22) Filed: Feb. 6, 2006

(65) Prior Publication Data

US 2007/0182660 A1 Aug. 9, 2007

(51) Int. Cl.
*H01Q 11/02* (2006.01)

(52) U.S. Cl. ..... 343/876; 343/893; 340/572.7

(58) Field of Classification Search ..... 343/867, 343/893; 340/572.7
See application file for complete search history.

(56) References Cited

U.S. PATENT DOCUMENTS 6,069,564 A * 5/2000 Hatano et al. ..... 340/572.7
7,084,769 B2 * 8/2006 Bauer et al. ..... 340/572.7
2003/0001787 A1 * 1/2003 Clifton ..... 343/702
2004/0227619 A1 * 11/2004 Watanabe ..... 340/10.34
2006/0132287 A1 * 6/2006 Phipps et al. ..... 340/10.1

* cited by examiner

*Primary Examiner*—Trinh V Dinh
*Assistant Examiner*—Dieu Hien T Duong
(74) *Attorney, Agent, or Firm*—Ming Chow; Sinorica, LLC

(57) ABSTRACT

The present invention provides a control apparatus of an antenna array. The control apparatus of an antenna array comprises a control circuit including a serial interface circuit connected to the first switch and the second switch by a first control line and a second control line separately, and an antenna coupled between the first switch and the second switch. The serial interface circuit controls On/Off status of the first switch and the second switch separately through the first control line and the second control line. Furthermore, the control circuit and the others can be connected serially through the included serial interface circuits to increase the number of antennas.

17 Claims, 3 Drawing Sheets

CONTROL SYSTEM OF ANTENNA ARRAY OF RFID READER APPLICATIONS

BACKGROUND OF THE PRESENT INVENTION

1. Field of Invention

The present invention relates to a control apparatus of an antenna array, and more particularly to a control apparatus of an antenna array capable of increasing the number of antennas.

2. Description of Related Arts

A communication system requiring a plurality of antennas is not suitable for employing only one antenna when applied to Radio Frequency Identification (RFID) technology to identify the position of a tag. An RFID system employing only one antenna to identify a plurality of tags and their positions must cooperate with more complex software to deal with the information of the tags. And this method also can't be employed to identify accurately whether a tag is placed at a suitable position. Therefore, it is more suitable to employ a plurality of antennas in an RFID System for identifying whether RFID tags are placed at the right positions or not. If a specific tag in a readable range of a corresponding antenna can be identified by the corresponding antenna, it can be determined that the specific tag or the object with the specific tag is placed at the right position.

The conventional technology is to set the number of antennas of system as a fixed value. If the system needs to change the number of antennas, the circuit must be re-designed. That will increase the development time and the cost.

The present invention is directed to overcome, or at least reduce the effects of, one or more of the problems set forth above.

SUMMARY OF THE PRESENT INVENTION

An object of the present invention is to provide a control apparatus of an antenna array. The control apparatus equips with a plurality of antennas for transmitting or receiving electromagnetic wave to identify the position of a tag in the Radio Frequency Identification technology.

Another object of the present invention is to provide a control circuit comprising a plurality of the first switches and the second switches, wherein the On/Off statuses of the first switches and the second switches are separately controlled by a plurality of the first control lines and the second control lines.

Another object of the present invention is to provide a serial interface circuit. The serial interface circuit can be connected to other serial interface circuits of the control circuit through a control bus to increase the number of antennas that can be utilized in the system.

Accordingly, in order to accomplish the one or some or all above objects, the present invention provides a control apparatus of an antenna array of RFID reader, comprising:

a first switch;

a second switch;

an antenna connected between the corresponding first switch and the corresponding second switch; and a control circuit comprising a serial interface circuit connected to the corresponding first switch and the corresponding second switch through the first control line and the second control line separately, wherein the On/Off statuses of the first switch and the second switch are separately controlled by the corresponding first control line and the second control line.

One or part or all of these and other features and advantages of the present invention will become readily apparent to those skilled in this art from the following description wherein there is shown and described a preferred embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

DETAILED DESCRIPTION OF THE PREFERRED EMBODIMENT

The following examples are included to demonstrate illustrative embodiments of the invention. It should be appreciated by those of skill in the art that the techniques disclosed in the examples which follow represent techniques discovered by the inventor to function well in the practice of the invention, and thus may be considered to constitute illustrative modes for its practice. However, those of skill in the art should, in light of the present disclosure, appreciate that many changes may be made in the specific embodiments which are disclosed and still obtain a like or similar result without departing from the spirit and scope of the invention.

Figure 1:
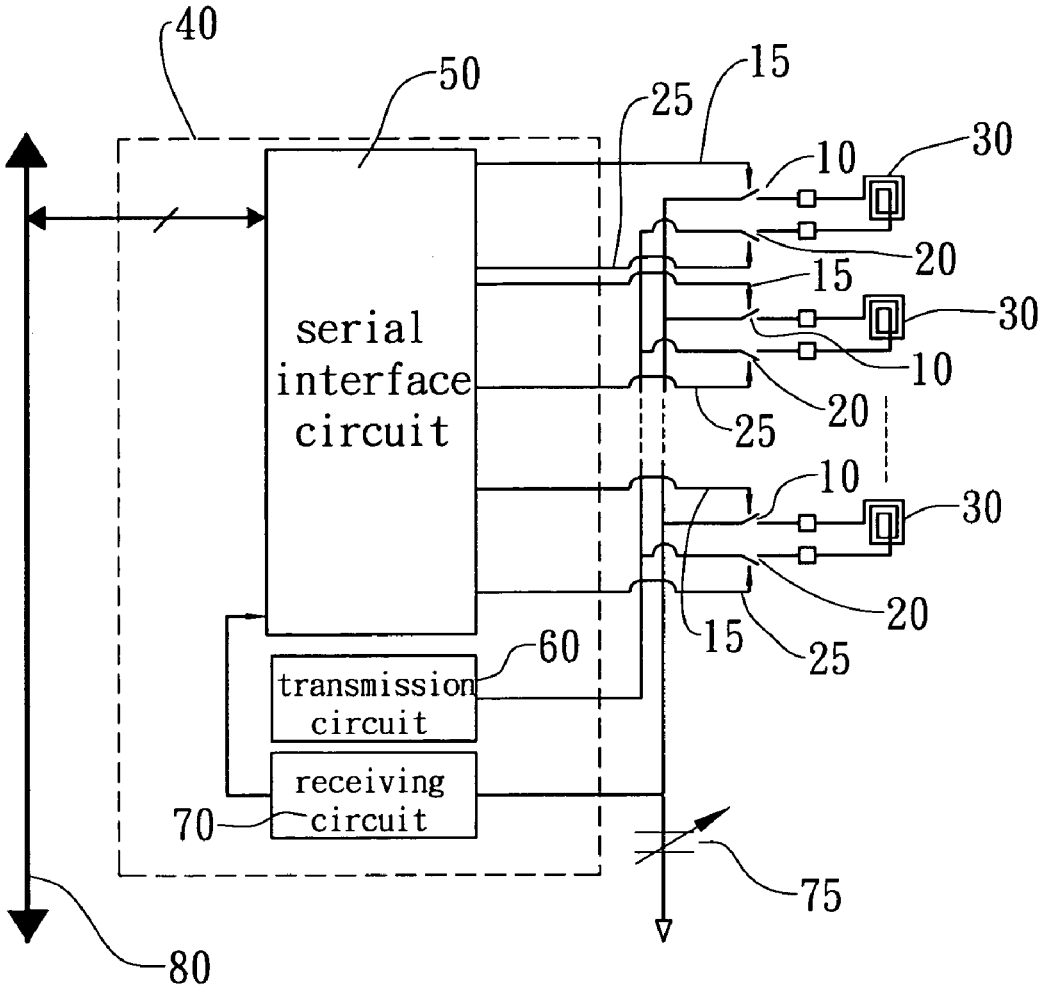
FIG. 1 is a schematic diagram of a control apparatus of an antenna array according to a preferred embodiment of the present invention.

Please refer to FIG. 1, which shows one of the preferred embodiments of present invention. The control apparatus of an antenna array comprises a plurality of the first switches 10, a plurality of the second switches 20 and a plurality of the antennas 30. Every antenna is connected between the corresponding first switch 10 and the corresponding second switch 20. And a control circuit 40, which is included in the control apparatus, comprises a serial interface circuit 50 connected to the first switches 10 and the second switches 20 through a plurality of the first control lines 15 and the second control lines 25 separately, wherein the On/Off statuses of the first switches 10 and the second switches 20 are controlled by the serial interface circuit 50 through the corresponding first control lines 15 and second control lines 25 separately.

Furthermore, the present invention may also comprise a control bus 80 connected to every serial interface circuit 50 of the control circuit 40 to transmit data to every control circuit 40. By this way, the apparatus can employ more antennas 30.

The serial interface circuit 50 provides the first switch control signal to control the first switches 10 through the first control lines 15. In addition, the serial interface circuit 50 also provides the second switch control signal to control the second switches 20 through the second control lines 25.

The control circuit 40 further comprises a transmission circuit 60. The transmission circuit 60 provides a modulated transmission signal carried by a carrier frequency and transmits the transmission signal to an antenna 30 through the first switch 10. The transmission signal is transformed to electromagnetic wave and then radiated to the air by the antenna 30.

The control circuit 40 further comprises a receiving circuit 70. The receiving circuit 70 demodulates a receiving signal by setting a carrier frequency. The receiving signal, which is an electromagnetic wave signal, is transmitted from a tag (not shown) and received by the antennas 30. The electromagnetic wave is transformed to a receiving signal by the antenna 30 and transmitted to the receiving circuit 70 through the second switches 20, and then demodulated by receiving circuit 70 to recover.

Every first switch 10 comprises an input port connected to an output port of the corresponding transmission circuit 60, a control port connected to the serial interface circuit 50 with the first control line 15 and receiving the first switch control signal provided by the serial interface circuit 50 for controlling the On/Off status of the first switch 10, and an output port connected to the antenna 30. The transmission signal provided by the transmission circuit 60 is input to the antenna 30 and radiated to the air.

Every second switch 20 comprises an input port connected to the antenna 30 and receiving the receiving signal transformed by the antenna 30, a control port connected to the serial interface circuit 50 with the second control line 25 and receiving the second switch control signal provided by the serial interface circuit 50 for controlling the On/Off status of the corresponding second switch 20, and an output port connected to the receiving circuit 70. The receiving signal transformed by the antenna 30 is transmitted to the receiving circuit 70 to recover.

It is noted that the carrier frequency utilized in the transmission circuit 60 and receiving circuit 70 is decided by the capacitor 75.

Figure 2:
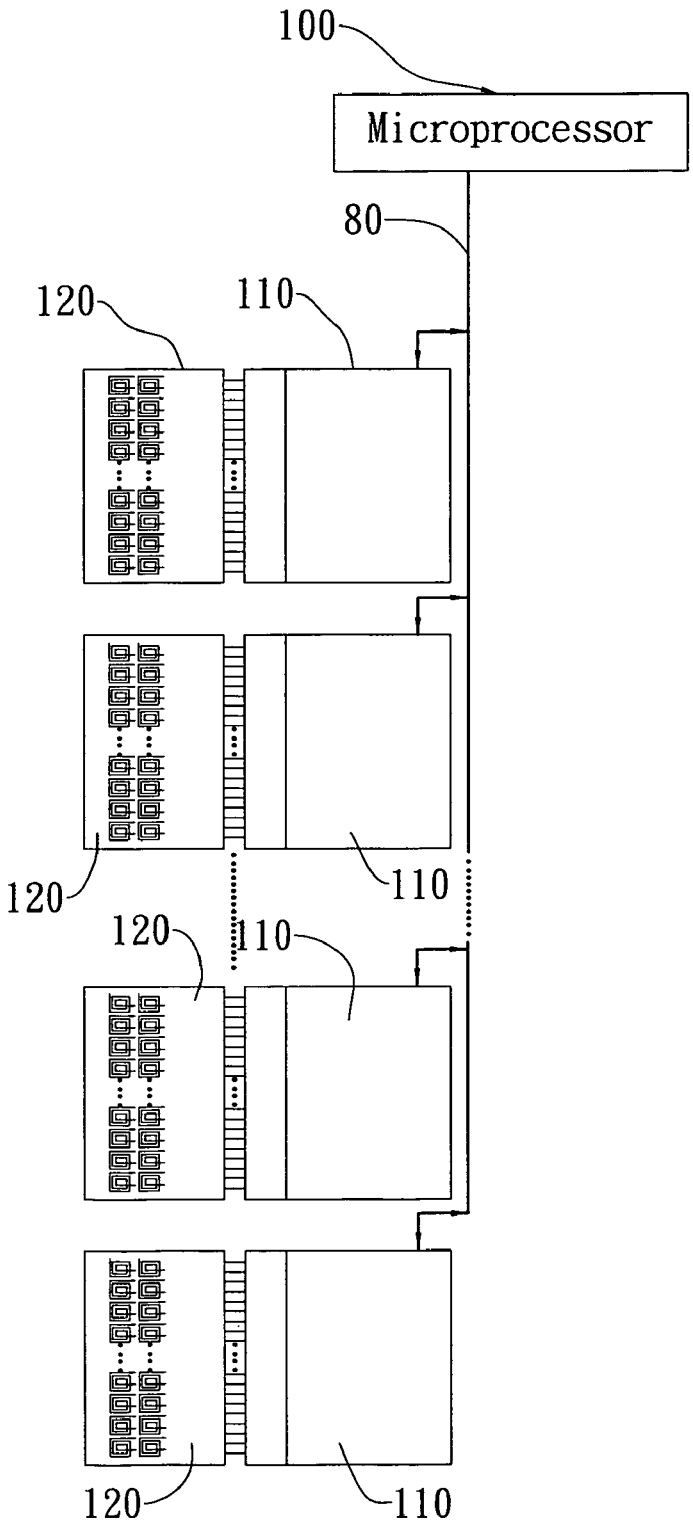
FIG. 2 is a schematic diagram of serial connecting method of a control apparatus of an antenna array according to a preferred embodiment of the present invention.

Please refer to the FIG. 2 and FIG. 1 at the same time. It illustrates another preferred embodiment of present invention. The present invention further comprises a microprocessor 100 for transmitting a control signal to the control circuit 110 through the control bus 80 to control the On/Off statuses of the first switches 10 and the second switches 20. The microprocessor 100 also can indirectly control the antenna arrays 120 composed of the antennas 30 to separately determine that the antenna arrays 120 are used for transmission or reception. By this way, the control circuit 110 can connect with other control circuits 110 serially to increase the number of antennas 30 employed in the apparatus.

Figure 3:
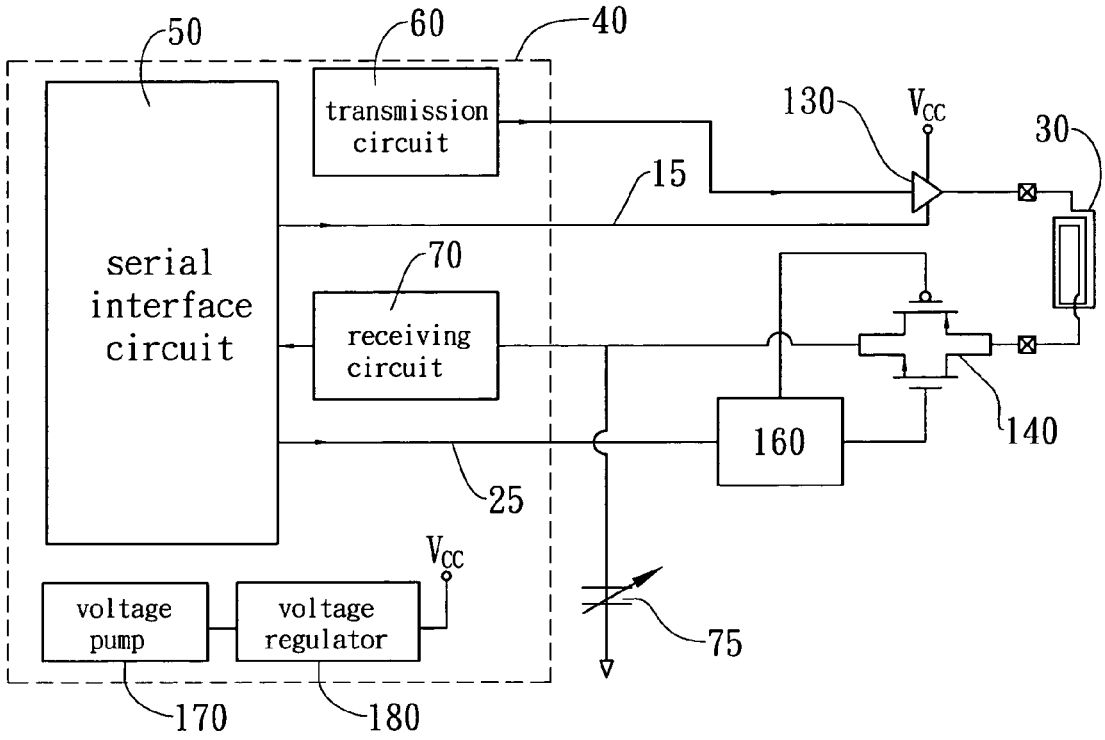
FIG. 3 is a circuit diagram of a control apparatus of an antenna array according to a preferred embodiment of the present invention.

Please refer to the FIG. 3 and FIG. 1 at the same time. It illustrates another preferred embodiment of present invention. For clearly describing this embodiment, every first switch 10 may comprise a tri-state gate 130 or a transmission gate (not shown). And every second switch 20 may comprise a transmission gate 140.

In addition, the control circuit 40 further comprises a voltage boosting circuit including a voltage pump 170 and a voltage regulator 180. The voltage boosting circuit is used to provide a power. The voltage pump 170 raises the voltage level provided from an external power source. Then the voltage regulator 180 stabilizes the boosted voltage level and provides a steady power. The steady power is provided for the buffers 160 of the tri-state gate 130 and the transmission gate 140. By this way, the tri-state gate 130 raises the current level and increase the power level of transmission signal, and the transmission gate 140 raises the voltage level and decrease the conducting resistance of the transmission gate 140. Furthermore, the tri-state gate 130 connected to the external power source directly without the voltage boosting circuit in another embodiment.

Furthermore, the serial interface circuit 50 can be a serial peripheral interface (SPI) or a universal serial bus (USB). The control bus 80 can indirectly control the antennas 30 and determine the antennas 30 that are used to transmission or reception by serially connecting the serial interface circuits 40 of the control circuits 50. By this way, it can increase the number of the antennas employed in apparatus.

One of the applications of present invention is to be employed to the RFID technology in Monopoly board game. The substrate of the board has an antenna array composed of a plurality of the antennas distributed on the substrate. When the jigsaw with a RFID tag is placed at the specific position and identified by corresponding antenna, it can be determined that the jigsaw is placed at the right position. The jigsaw can also be a cubic object and then tags can be placed at each face of the cubic jigsaw. When one of the tags of the jigsaw is close to the substrate and is identified by a specific antenna, a corresponding action is executed. When the size of the substrate needs to be expanded and the number of antennas needs to be increased, the easy expanding feature of the present invention is capable of being adapted to increase the number of the antennas employed in apparatus.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A control apparatus of an antenna array, comprising:

a first switch;

a second switch;

an antenna connected between the first switch and the second switch;

a control circuit comprising a serial interface circuit connected to the first switch and the second switch through a first control line and a second control line separately, wherein a first and a second On/Off status of the first switch and the second switch are separately controlled by the first control line and the second control line;

wherein the serial interface circuit connects to a plurality of first switches and a plurality of second switches to increase the number of the antennas;

wherein the serial interface circuit transmits a first switch control signal through a plurality of first control lines to control the plurality of first switches;

wherein the serial interface circuit transmits a second switch control signal through a plurality of second control lines to control the second switches; and wherein the control circuit further comprises a receiving circuit arranged between the serial interface circuit and the second switch for demodulating a receiving signal.

2. The control apparatus, as recited in claim 1, wherein the control circuit comprises a voltage boosting circuit with an input port connected to an external power source, wherein the voltage boosting circuit comprises a voltage pump and a voltage regulator.

3. The control apparatus, as recited in claim 2, wherein the control apparatus further comprises a microprocessor transmitting a control signal to the control circuits through a control bus to control the first and second On/Off status.

4. The control apparatus, as recited in claim 1, wherein the control circuit further comprises a transmission circuit providing a transmission signal.

5. The control apparatus, as recited in claim 4, wherein each of the first switches comprises:

a first input port connected to an output port of the transmission circuit;

a first control port connected to the serial interface circuit through the first control line to control the first On/Off status; and a first output port connected to the antenna to input the transmission signal provided by the transmission circuit to the antenna and radiating to the air.

6. The control apparatus, as recited in claim 5, wherein each of the first switches comprises a tri-state gate or a transmission gate.

7. The control apparatus, as recited in claim 1, wherein the serial interface circuit comprises a serial peripheral interface or a universal serial bus.

8. The control apparatus, as recited in claim 1, wherein each of the second switches comprises:

a second input port connected to the antenna to receive the receiving signal transformed by the antenna;

a second control port connected to the serial interface circuit through the second control line to control the second On/Off status; and a second output port connecting to the receiving circuit to input the receiving signal transformed by the antenna to the receiving circuit to demodulate the receiving signal.

9. The control apparatus, as recited in claim 8, wherein each of the second switches comprises a transmission gate.

10. A control apparatus of an antenna array, comprising:

a first switch;

a second switch;

an antenna connected between the first switch and the second switch; and a serial interface circuit connected between the first switch and the second switch to increase the number of the antennas of the antenna array;

wherein the serial interface circuit transmits a first switch control signal through the first control line to control the corresponding first switch;

wherein the serial interface circuit transmits a second switch control signal through the second control line to control the corresponding second switch; and a control circuit comprises a receiving circuit arranged between the serial interface circuit and the second switch for demodulating a receiving signal.

11. The control apparatus, as recited in claim 10, wherein the serial interface circuit further comprises a voltage boosting circuit with an input port connected to an external power source, wherein the voltage boosting circuit comprises a voltage pump and a voltage regulator.

12. The control apparatus, as recited in claim 10, wherein the control apparatus further comprises a microprocessor transmitting a control signal to the control circuits through a control bus to control the first and second On/Off status.

13. The control apparatus, as recited in claim 10, wherein the serial interface circuit comprises a serial peripheral interface or a universal serial bus.

14. The control apparatus, as recited in claim 10, wherein the first switch comprises:

a first input port connected to an output port of the transmission circuit;

a first control port connected to the serial interface circuit through the first control line to control the first On/Off status; and a first output port connected to the antenna to input the transmission signal provided by the transmission circuit to the antenna and radiating to the air.

15. The control apparatus, as recited in claim 14, wherein the first switch comprises a tri-state gate or a transmission gate.

16. The control apparatus, as recited in claim 10, wherein the second switch comprises:

a second input port connecting to the antenna to receive the receiving signal transformed by the antenna;

a second control port connected to the serial interface circuit through the second control line to control the second On/Off status; and a second output port connecting to a receiving circuit to input the receiving signal transformed by the antenna to the receiving circuit to demodulate the receiving signal.

17. The control apparatus, as recited in claim 16, wherein the second switch comprises a transmission gate.

* * * * *